US005968311A

United States Patent [19]

Zupon, Jr. et al.

[11] Patent Number: 5,968,311

[45] Date of Patent: Oct. 19, 1999

[54] DEVICE FOR APPLYING VAPOR RETARDER

[75] Inventors: Lawrence E. Zupon, Jr.; Stephen R. Neff, both of Solon, Ohio

[73] Assignee: Perfect R Incorporated, Solon, Ohio

[21] Appl. No.: 08/933,723

[22] Filed: Sep. 19, 1997

[51] Int. Cl.[6] ..... B44C 7/00; E04B 1/00; E04G 21/00; E04G 23/00

[52] U.S. Cl. ..... 156/577; 156/71; 156/575; 156/574; 52/746.11; 52/746.12

[58] Field of Search ..... 156/71, 574, 577, 156/575; 52/746.11, 746.12

[56] References Cited

U.S. PATENT DOCUMENTS

| | | | |
|---|---|---|---|
| 4,589,241 | 5/1986 | Volpenhein | 52/315 |
| 4,631,108 | 12/1986 | Colson | 156/461 |
| 4,736,552 | 4/1988 | Ward | 52/94 |
| 4,781,782 | 11/1988 | Luhman | 156/361 |
| 4,967,535 | 11/1990 | Alderman | 52/749 |

OTHER PUBLICATIONS

Owens Corning Fiberglass, "Elaminator System for Insulating Pre–Engineered Steel Roof Assemblies," (Sep. 1993).

*Primary Examiner*—Jeff H. Aftergut
*Assistant Examiner*—Robert Hendrix
*Attorney, Agent, or Firm*—Oldham & Oldham Co., LPA

[57] ABSTRACT

A device for applying a vapor retarder film onto purlins on a roofing system has a base with rollers and guides for directing the base across the purlins. The base has a fore end and an aft end with a pair of side members. The base moves across the purlins such that the side members remain in a fixed spaced apart relationship wider than the spacing between the pair of purlins. A vertical member attached to each of the side members provides a means for mounting a web of the vapor retarder film on a roll above the base and the adjacent pair of the spaced apart purlins. Adhesive is dispensed onto the edges of the web and the web is payed out and guided onto the purlin so that the edge of the web having the adhesive is put into adhesive engagement with the top surface of the purlins and the film sealingly spans the interval between the adjacent purlins. By use of a plurality of these devices acting in parallel, a method of applying the web to the roof purlins is taught.

9 Claims, 3 Drawing Sheets

DEVICE FOR APPLYING VAPOR RETARDER

The present invention relates to a device for applying a sheet of vapor retarder material to a roof support as a step in the placement of a roof on a structure. More particularly, the invention relates to a device which rides upon a pair of adjacent roof purlins, places an adhesive between the top of the roof purlins and the vapor retarder sheet, thereby providing a vapor retarder sheet which is adhered to the purlins and spans the intervening space between the purlins onto the adhesive.

BACKGROUND OF THE ART

The method of applying a vapor retarder sheet or the like as one step of applying a roofing system is described in full detail in U.S. Pat. No. 4,736,552, which issued on Apr. 12, 1988 to Lonnie R. and Cherryl A. Ward, and that patent is incorporated by reference as if fully recited herein. The Ward '552 patent teaches a roof system and method of fabricating, as used on a building with a plurality of parallel and spaced apart elongated structural support units defining a longitudinal surface exposed from above. The spacing between these structural support units is generally consistent across the longitudinal surface. A first step in applying a roof to this type of structure involves securing a flexible, generally moisture impervious sheet over the longitudinal surface to act as a vapor retarder between the building interior and exterior. The method as described in Ward '552 involves placement of a double-faced adhesive tape along the top surface of the support units and then applying lengths of the sheet material as payed off of rolls thereof atop the doubled faced adhesive tape which are on adjacent support units. The sheet material applied is sufficiently wide to cover the adjacent top surfaces and the intervening space therebetween. By applying a second piece of the double-faced adhesive tape over a vapor retarder sheet atop the first piece of double-faced adhesive tape, an adhesive surface for placement of an overlapping sheet of the vapor retarder material is provided. In this manner, a continuous uninterrupted surface of the vapor retarder material is secured to the top surface of the support units. Although the Ward '552 patent teaches the method of applying such a roofing system and also the roofing system achieved as a result of the method, it does not teach a device for accomplishing the step of adhering the vapor retarder to the roof supports.

SUMMARY OF THE INVENTION

Accordingly, it is an object of the present invention to provide a device for adhering a sheet of vapor retarder material spanning the intervening space between the pair of roof supports, using a line of adhesive which has been placed onto an edge surface of the web immediately before engaging the web surface to the roof support. This and other objects of the invention are provided by a device for applying a vapor retarder film atop a pair of adjacent parallel spaced apart purlins having a top surface in a roofing system having a plurality of the purlins with an interval between the purlins. The device comprises a base with a fore end and an aft end. A pair of side members are a part of the base and the base is provided with a means for moving it along the length of the pair of purlins such that the side members are in a fixed spaced apart relationship wider than the spacing between the pair of purlins. The device further has a vertical member attached to each of the side members, with a means for mounting a web of the vapor retarder film on a roll above an adjacent pair of the spaced apart purlins. The device has a means for dispensing a continuous line of adhesive along an edge of a surface of the web of vapor retarder film and a means for paying out and guiding the vapor retarder film such that the edge having the line of adhesive is in adhesive engagement with the top surface of the purlins and the film sealingly spans the interval between the adjacent purlins.

BRIEF DESCRIPTION OF THE DRAWINGS

In the accompanying drawings, in which identical parts are identified by identical reference numerals and in which.

DETAILED DESCRIPTION OF THE DRAWINGS

Figure 1:
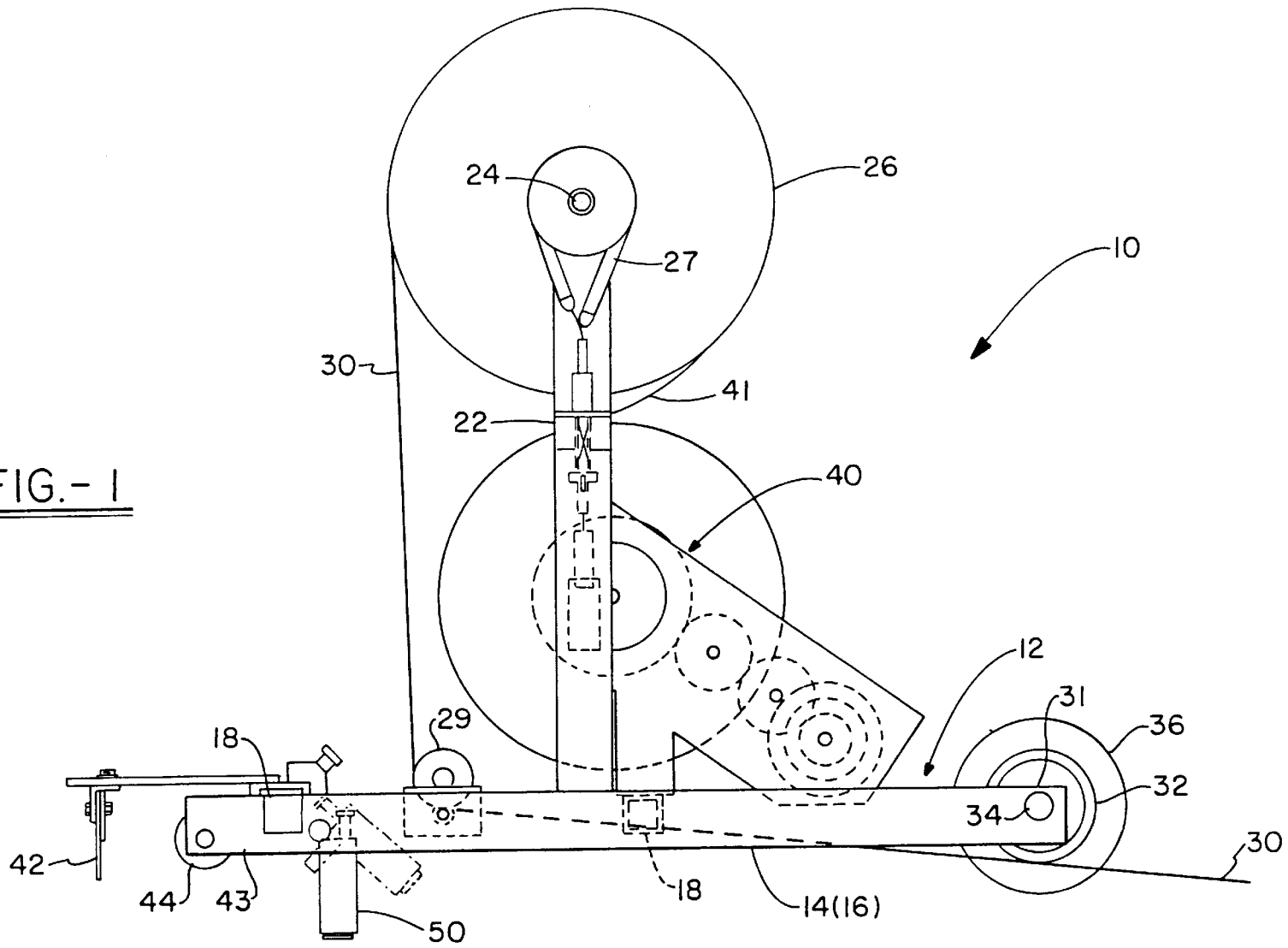
FIG. 1 is a side elevation view of the device of the present invention.

In a roofing system as shown in FIG. 1 of Ward '552, a plurality of purlins are provided in parallel equally spaced-apart relationship to define a generally planar surface for the placement of a roofing system thereupon, with an intervening space between adjacent purlins. In a typical application, these purlins are about 2.5 inches wide and are spaced about 60 inches apart, as measured center to center. Although Ward '552 describes the steps in applying the roofing system, that patent is silent as to the preferred technique or device used in the application of a vapor retarder sheet atop the purlins which spans the intervening space between the adjacent purlins, and the implication is that a manual technique is used. It will be readily understood that the present invention device will achieve this purpose and that it has application to a variety of roofing systems and the width of the purlins and their spacing may be accommodated by variations in the device.

In the method as described by Ward '552, a vapor retarder sheet is typically laid down in strips parallel to the plurality of parallel spaced apart purlins of a roofing system, after which blankets of an insulation layer are placed atop the vapor retarder in a juxtaposed transverse manner. This insulation layer is then covered by the roofing surface, which is generally laid in the same direction as the insulation. The device of the present invention operates to lay the vapor retarder in the same direction, with the insulation and roofing surface being laid transverse to the vapor retarder.

Figure 2:
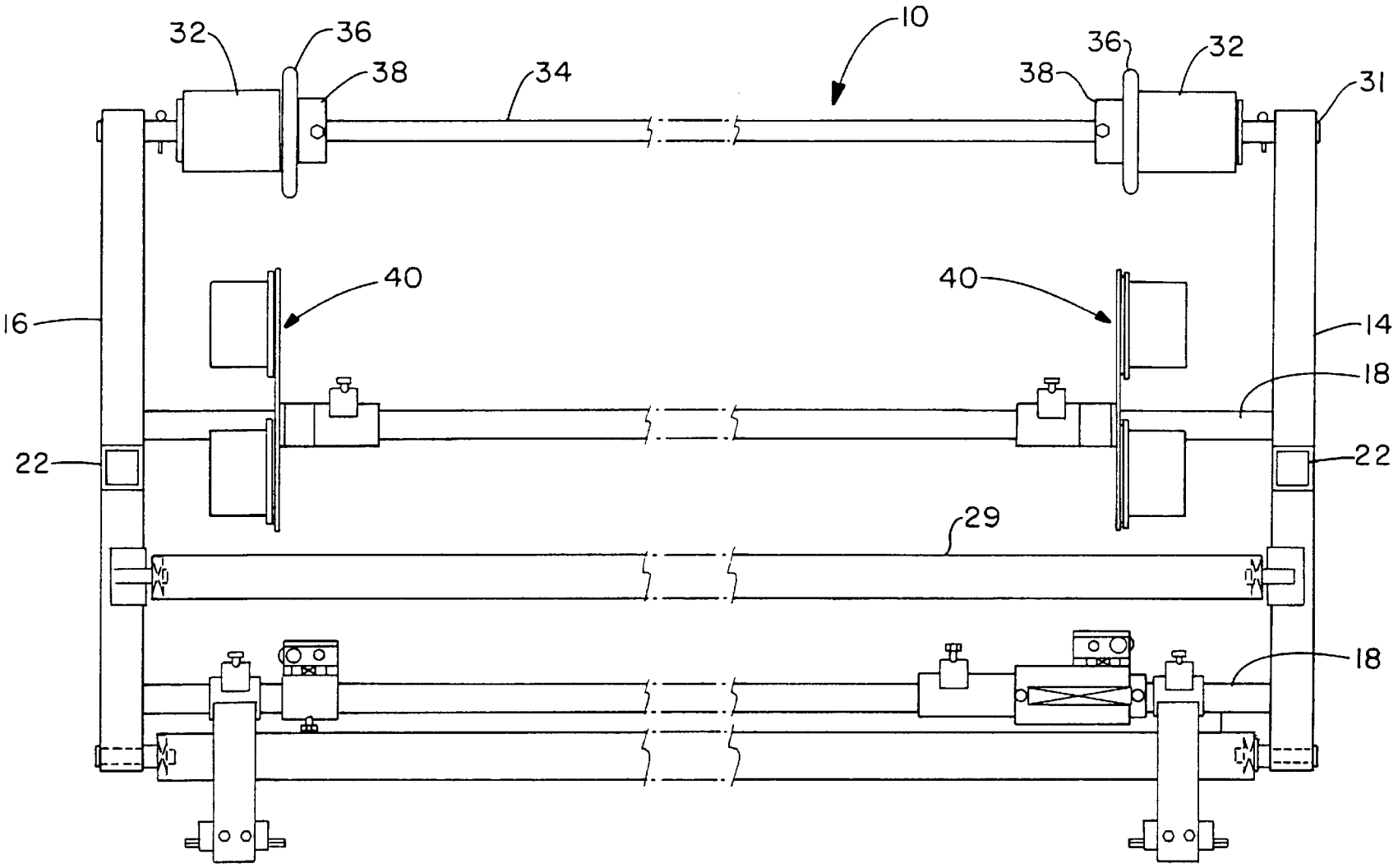
FIG. 2 is a top plan view of the device of the present invention.
Figure 3:
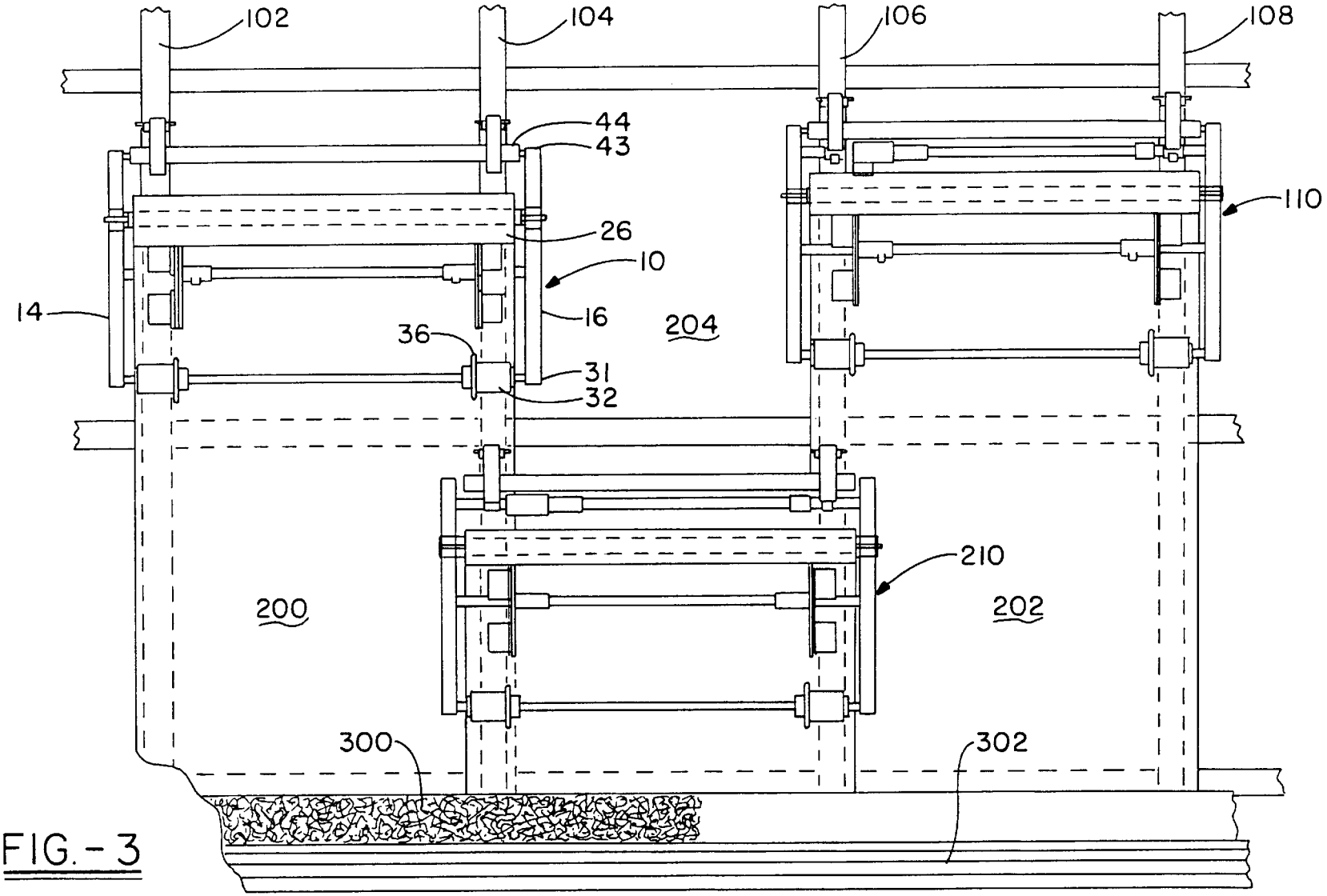
FIG. 3 is a top plan view of three of the devices of the present invention placing vapor retarder web on a roof surface.

The device of the present invention is shown in FIGS. 1–3; FIG. 1 showing a side elevation view from the right side of the device; FIG. 2 showing a top plan view and FIG. 3 showing a plurality of the devices in use on a roofing surface applying a vapor retarder web. The device 10 comprises a base 12 which is preferably rectangular and which has a width sufficient to span a pair of spaced apart purlins, and, in fact, to extend outwardly beyond the edges of the purlins. The base 12 having this rectangular shape has a pair of parallel side members 14, 16 which are positioned parallel to the adjacent purlins upon which the device 10 will be moved. Connecting the side members 14, 16 are at least two cross members 18, which hold the side members in their parallel spaced apart position. Although the cross members 18 will be located either slightly above the top surface of the purlins or will actually rest upon the top surface, the side members 14, 16 may have a portion pending below the top surface, so that the center of gravity of the device is kept low.

In the preferred embodiment of the present invention, each of the side members 14, 16 has a vertical member 22 affixed thereto in a position which is substantially normal to the side member. While the preferred method of affixation is direct welding of the vertical member 22 to the side member 14 or 16, the affixation may also be assisted by the use of a collar (not shown) which is affixed to the side members 14, 16 and receives a first end of the vertical member 22. The use of such a collar permits the device 10 to be assembled and broken down easily, which may be very advantageous, since the devices are moved from one site to another often and will need to be lifted from the ground to the roof for use. The vertical members 22 on the side members 14, 16 are in alignment, so that a straight line between them would be perpendicular to the longitudinal axes of the purlins they straddle. If the vertical members are mounted in collars, it would be quite desirable to use a vertical member with a rectangular or other non-circular polygonal cross-section to eliminate rotation of the cross member, but this is not required when the vertical members are affixed to the side members permanently, as by welding.

Each vertical member 22 is equipped towards its second end with a means 24 for mounting a roll 26 of the vapor retarder material such that the axis of the roll is transverse to the length of the purlins. As the direction of pay out of the vapor retarder material is parallel to the length of the purlins, the roll mounting means 24 on each vertical side frame member should be positioned to mount the roll perpendicular to the purlin length direction. The means 24 for mounting the roll of the vapor retarder material may be either a spindle which spans the distance between the vertical members 22 mounted in the side members 14, 16 or merely rotatable stub members on each of the vertical members 22 to receive an end of the roll. Although the general goal is always to keep the center of gravity of the device 10 low to stabilize the device, the means 24 for rotatably mounting will be located at least one radius of a full roll above the top of the purlins, to avoid the purlins from interfering with the pay out of the vapor retarding sheet material. This is because the width of the roll of web material used is at least as wide as the separation between the purlins, in order to span the intervening distance. In fact, the roll will normally be even wider to allow a preset depth to accommodate the insulation thickness.

The roll 26 will not generally be mounted on the means 24 for mounting such that the roll may freely rotate. A means for braking 27 should be installed to the mounting means to provide a braking bias in either possible direction of rotation. Although the device itself is designed for movement in only one direction and so the roll will normally pay off the web in a direction consistent with that movement, it has been determined that external forces such as wind can also pay a significant factor in the operation of the device. The failure to account for rotation in either direction can easily result in the web freely rotating on the mounting means and not maintaining the web in a taut position as it is payed off and guided toward the purlins. In the specific embodiment illustrated in the Figures, the braking means 27 is a spring biased belt which passes around the mounting means.

In preferred embodiments of the device 10, there will be a means provided to align and guide the edges of the payed out web 30 of material as the web leaves the roll and moves toward the purlins. In the particular embodiment disclosed in the figures, the web is payed out in a counterclockwise manner, that is, over the top of the roll 26, directly down to and around roller 29 and towards the aft end 31 of the device in a direction essentially parallel with the top surface of the purlins. The means for guiding the web will be attached to the side members 14, 16, and will provide a course through which the web 30 will be fed. At an aft end 31 of the device 10, each of the side members 14, 16 has a roller 32 extending from it into the intervening space between the side members. As shown in the accompanying figures, the rollers 32 are slidably mounted along a shaft 34 running between the side members, but it would also be possible to cantilever the rollers into the intervening space from the inner surfaces of the side members. The rollers 32 each have an enlarged flange 36 on the side distal from the side member. When positioned on the purlins, these flanges 36 may be adjusted to bear slightly against the facing surfaces of the purlins. The flanges 36 have the dual purpose of aligning and holding the device in a parallel course as it moves along the axial direction of the purlins and pushing the vapor retarder web downwardly between the purlins to provide a preset depth for accommodating the depth of the insulation to be placed thereacross. A locking clamp 38 associated with each roller 32 allows the roller to be fixed in position on the shaft 34 at a width appropriate to the purlin spacing.

The device 10 is also provided with a means 40 for dispensing an adhesive such that the adhesive is applied either to the top surface of the purlin or to the surface of the web which will be applied to the purlin. In the preferred embodiments, the means 40 dispenses the adhesive directly onto the vapor retarder web along its side edges while the web 30 is still on the roll 26. In these preferred embodiments of the invention, the adhesive used is a double-faced tape 41 provided in a roll form, although some embodiments would allow the use of a liquid adhesive provided that such a liquid adhesive would be relatively fast-setting. The preferred dispensing means 40 for such a tape 41 is a mounting means which allows a roll of the tape to be positioned onto each of the side edges of the web 30 while it is still on the roll 26, where the tape is payed out and guided onto the web with sufficient pressure to adhere the pressure sensitive adhesive on a first side of the tape to the surface of the web. The tape 41 is guided onto the web 30 to lie in a line which will correspond to the longitudinal axis of the purlin when the web is guided onto the purlin. If a release lining is provided on the second side of the tape, that is, the side which faces upwardly after the first side has been attached, then means should be provided to remove this release lining after the first side is adhered to the purlin surface. In the preferred embodiment, the web 30 of film is generally drawn off of the roll 26 in a counterclockwise manner over the top of the to roll 26, straight downwardly to roller 29 and then essentially straight aft towards the aft end of the device, at which it is affixed to the purlins. For this reason, the means 40 for dispensing the adhesive 41 is positioned generally below and behind the payed out web. The dispensing means 40 is preferably mounted to the base 12, so that it may be located directly above the purlin to which the web is to be adhesively engaged. As with the web roll 26, there is a need to raise it above the level of the purlin to allow the double-sided tape 41 to pay off of the roll from which it is dispensed. In preferred embodiments of the invention, the web 30 will be held relatively tautly while the adhesive 41 is being applied, to assure good adhesion. As recited above, a roller 32 positioned atop the web 30 at the point of contact with the purlin top surface is very useful in pressing the web down into contact with the purlin so that the exposed adhesive on the second side of the tape is adhered to the top surface of the purlin. If, as is clearly preferred, the web or sheet has a width essentially equal or greater than the spacing between the outside edges of the purlins, the longitudinal edges of the web or sheet will lie generally atop the outside edges of the adjacent purlins.

Although the preferred embodiments of the invention as described above place the adhesive first on the payed out web and then adhere the web to the purlin (in a manner unlike that taught by Ward '552, where the adhesive is placed on the purlin), it is certainly possible to alternatively make the first adhesion of the double-sided tape to the top surface of the purlin and then to bring the web edges into adhesively engagement, which is the method of Ward '552.

FIG. 3 illustrates use of the device on roofing surface. The device 10 of the present invention would be used by positioning and aligning the device on a pair of adjacent purlins 102, 104 at a roofing termination, where a transverse support member running between the adjacent purlins is available. An adhesive, preferably the same adhesive, such as tape 41 used with the device, is placed along the top surface of the transverse support member and the payed out end of the web or sheet 30 of vapor retarder material is adhered to the top of the transverse support member. If the adhesive to be used on the web is also a tape or roll 41, the payed out end of such roll is adhered to the side edge of the web. Of course, this is done on both of side edges, so that the vapor retarder web or sheet 30 has its payed out end adhered not only on the payed out end, but also along each longitudinal edge.

The device 10 is now urged outwardly onto the purlins 102, 104 by the user. Rollers 32, 44 on the device support the device atop the purlins and flanges 36 on the rollers may be used to guide the rollers along the edges of the purlins, assuring a straight traverse. Because the purlins may not be in exact parallel relationship, it is considered relatively important that the base 12 be provided with at least one outwardly-biased spring-loaded vertical roller 50, where the roller engages the purlin edges toward the front of the device so that the device will cleanly track the purlins even if the purlins are not in exact parallel relationship. To achieve this objective, the spring-loaded rollers 50 should have about one to two inches of play available for adjusting the tracking of the device on the purlins. A push rod or bar (not shown) can be used to push the device 10 out onto the purlins, typically at a distance of six feet or so at a time. The push rod is not affixed to the device 10, but should be adapted at its distal end to be received by the aft end 31 of the device 10. A particularly good spot for pushing the device is the rear cross member 18. The adhesion of the web 30 to the top surface of the purlin pays out the sheet in a secure manner, with the web being unsupported between the purlins, and the guiding means continues to make adhesive contact of the web with the purlin as the device moves.

In the preferred use of the devices, a plurality of the devices will be set out on the purlins to be covered with the vapor retarder film. These devices will comprise essentially two sets. The first set, comprising devices 10 and 110 in FIG. 3, will straddle a first set of alternating intervening spaces 200, 202 between the purlins. In this case, device 10 straddle purlins 102, 104 and device 110 straddles purlins 104, 108. The second set, represented by a single device 210 in FIG. 3, will straddle the second set of alternating intervening spaces not covered by the first set. In FIG. 3, this alternating space 204 is shown as being between purlins 104 and 106. If the first set of devices has a slight lead over the second set, the second set of devices will be placing the adhesive tape and vapor retarder not directly on the purlins, but instead atop of the tape and vapor retarder already on the purlins from the first set, resulting in the type of overlapping joint taught by Ward '552. In operation each of the first set devices 10, 110 is advanced a short distance, typically six to ten feet, on the purlins and the second set of devices 210 is advanced until the front ends 43 of the second set devices are up to the aft ends 31 of the first set devices. At this point, insulation 300 and roofing 302 is secured to the section newly covered by the vapor retarder by laying the insulation and roofing in the transverse method described elsewhere in this specification. Once the insulation and roofing are in place, the first and second sets of devices are again advanced a short distance and the procedure repeats itself. At the opposite end of the purlin, an adhesive may be used to adhere the transverse edge of the web to a second transverse support member at that roof termination. If the web is insufficiently long to span the length of the purlins, the end of the prior web used may be used as the transverse support member for adhering the leading edge of a new sheet or web of the vapor retarder material.

It is also known to the inventors that the two sets of devices as shown in FIG. 3 can be used without deploying adhesive onto the web dispensed by the devices 10, 110 in the first or lead set. When this is done, the roller 32 toward the aft end of the lead or first set of devices effectively holds the web onto the purlin in tops until the second or following set 210 may pass over the web and adhesively contact a web from the second set of devices atop the web from the first set of devices, resulting in the overlapping seam. By doing this, the webs are not directly applied to the purlins, so there is some flexibility in movement of the vapor retarder layer consisting of overlapping parallel strips of web over the purlin tops, which is found to be useful in applying insulation over the vapor retarder layer. Of course, it will be highly desirable to adhere the outermost webs to the outermost purlins on each side of the roofing surface, so that the entire periphery of the sheet is adhered directly to the purlin tops. While the above-described methods are the preferred methods of using the device, it will be clear to one of skill in this art that a single device may be used in passes across the entire length of the purlins to lay down the vapor retarder, although this is clearly not the preferred method of use.

In addition to the features already described, there are other features which are considered useful to proper operation of the present invention. One of these features is to provide the device 10 with a doctor blade 42 and/or squeegee arrangement for preparing the top surface of the purlin by removing moisture or other foreign substances on the purlin top surface just prior to adhesively placing to the web onto the purlin top surface. This feature may be disengaged or pivoted out of service in passes across a purlin which has already been covered by one ply of the adhesive and the vapor retarder, in order to prevent damage to the retarder sheet. Such a cleaning arrangement would be mounted from the base, preferably at the fore or front end 43 of the device 10. It may also be useful to place adjustable, vertically oriented guide rollers 44 on the side members 14, 16, a cross-shaft or a cross member 18 to ride along and bear lightly against the inside or outside edge of the purlins, to keep the device tracking along the purlin as it moves therealong. In even further embodiments of the invention, the vertical member 22 for providing a mounting point for the roll of vapor retarder may be mounted to the side member 14, 16 in a removable or collapsible fashion so that the device may be easily transported. In a yet further embodiment of the invention, the cross members 18 connecting the side members 14, 16 and spanning the space between the purlins to be covered by the vapor retarder material will be easily removable so that a device 10 may be adjusted by replacement of the cross members to accommodate different purlin spacings and to allow the device to be disassembled for easier transport.

In some uses of the device, it will be preferred to assemble the devices at a staging site and to transport them not only assembled, but with the correct lengths of web and with the rollers preset at the purlin spacings. The assembled devices may be easily lifted in this assembled condition onto the roof and used. In other uses, the devices may be assembled and set up on the roof at the time of use.

While the preferred embodiment is described as required under the Patent Laws, the scope of the invention is not to be determined by the preferred embodiment, but instead by the accompanying claims.

What is claimed is:

1. A device for applying a vapor retarder film atop a pair of adjacent parallel spaced apart purlins having a top surface in a roofing system having a plurality of the purlins with an interval between the purlins, comprising:

a base having a fore end and an aft end with a pair of side members which are provided with a means for moving the base along the length of the pair of purlins such that the side members are in a fixed spaced apart relationship wider than the spacing between the pair of purlins;

a vertical member attached to each of the side members, the vertical members provided with a means for mounting a web of the vapor retarder film on a roll above an adjacent pair of the spaced apart purlins;

means for dispensing a continuous line of adhesive along and edge of a surface of the web of vapor retarder film; and means for paying out and guiding the vapor retarder film directly from the roll to the purlin such that the edge having the line of adhesive is in adhesive engagement with the top surface of the purlins and the film sealingly spans the interval between the adjacent purlins in an unsupported manner.

2. The device of claim 1 wherein the mounting means comprises a spindle having first and second ends and a pair of mounts for receiving one end of the spindle, the mounts being affixed to the vertical members.

3. The device of claim 1 wherein the mounting means comprises first and second stub members for receiving an end of the roll holding the film, one of the stub members affixed to each of the vertical members.

4. The device of claim 1 wherein the line of adhesive is provided by a roll of double-sided adhesive tape and the means for dispensing the line of adhesive comprises a mount for positioning the roll above the top of the web as it is payed out, a guide for aligning the tape into adhesive engagement of the edge of the web surface, and a means for removing a release liner from a second side of the tape.

5. The device of claim 1 wherein the line of adhesive is provided by a container of liquid adhesive and the means for dispensing the line of adhesive comprises a mount for positioning the container above the edge of the web and a nozzle for dispensing a bead of the adhesive in a continuous line onto the edge of the web.

6. The device of claim 1 wherein the line of adhesive is placed on the web edge immediately proximate to the engagement of the web to the purlin.

7. The device of claim 1 wherein the base is further provided at the fore end thereof with a means for preparing the top surface of the purlin prior to placement of the web of film thereon.

8. The device of claim 1 wherein the means for moving the base along the length of the pair of purlins comprises at least one roller.

9. A device for applying a vapor retarder film atop a pair of adjacent parallel spaced apart purlins having a top surface in a roofing system having a plurality of the purlins with an interval between the purlins, comprising:

a carriage member which is provided with a means for moving the carriage member along the length of the pair of purlins such that the carriage member moves substantially parallel to the pair of purlins;

a pair of vertical members attached to the carriage member, the pair of vertical members provided with a means for mounting a web of the vapor retarder film on a roll above an adjacent pair of the spaced apart purlins;

means for dispensing a continuous line of adhesive along and edge of a surface of the web of vapor retarder film; and means for paying out and guiding the vapor retarder film directly from the web to the purlin such that the edge having the line of adhesive is in adhesive engagement with the top surface of the purlins and the film sealingly spans the interval between the adjacent purlins in an unsupported manner.

* * * * *